US007828037B2

(12) United States Patent
Crider

(10) Patent No.: US 7,828,037 B2
(45) Date of Patent: Nov. 9, 2010

(54) PORTAL COVERING FOR CONTROLLED ENVIRONMENTS

(76) Inventor: Grant W. Crider, 2770 County Rd. 71, Bremen, AL (US) 35033

( * ) Notice: Subject to any disclaimer, the term of this patent is extended or adjusted under 35 U.S.C. 154(b) by 0 days.

(21) Appl. No.: 11/800,425

(22) Filed: May 4, 2007

(65) Prior Publication Data

US 2007/0277938 A1 Dec. 6, 2007

Related U.S. Application Data

(60) Provisional application No. 60/797,982, filed on May 5, 2006.

(51) Int. Cl.
*E06B 9/08* (2006.01)

(52) U.S. Cl. ..... 160/121.1; 160/85; 160/368.1

(58) Field of Classification Search ..... 160/85, 160/86, 120, 121.1, 122, 242, 266, 268.1, 160/270, 271, 273.1, 264
See application file for complete search history.

(56) References Cited

U.S. PATENT DOCUMENTS 3,789,904 A * 2/1974 Takazawa ..... 160/120
4,344,474 A * 8/1982 Berman ..... 160/121.1
4,418,739 A * 12/1983 Woolnough et al. ..... 160/120
4,436,137 A * 3/1984 Charles ..... 160/242
4,453,584 A * 6/1984 Steele ..... 160/121.1
4,825,921 A * 5/1989 Rigter ..... 160/23.1
5,195,594 A * 3/1993 Allen et al. ..... 169/48
5,566,736 A * 10/1996 Crider et al. ..... 160/121.1
5,785,105 A * 7/1998 Crider et al. ..... 160/243
5,960,847 A * 10/1999 Crider et al. ..... 160/121.1
6,138,739 A * 10/2000 Crider et al. ..... 160/273.1
6,189,592 B1 * 2/2001 Domel ..... 160/85
6,309,076 B1 * 10/2001 McVicker ..... 359/601
6,901,987 B1 * 6/2005 Graham ..... 160/121.1
6,942,001 B1 * 9/2005 Crider et al. ..... 160/241

* cited by examiner

*Primary Examiner*—Blair M. Johnson
(74) *Attorney, Agent, or Firm*—Kenneth M. Bush; Gerald M. Walsh; Bush Intellectual Property Law

(57) ABSTRACT

An apparatus for opening and closing a portal in a structure in which a curtain having elongated side portions is placed adjacent opposing sides of the portal. A first end of the curtain is attached to a first end of the portal. An opposite end of the curtain is upturned and attached to a varying means at the first end of the portal to vary the height of a pocket formed in the curtain. Magnetic sealing means are placed on the elongated side portions of the curtain and on the opposing sides of the portal. The portal is closed as the varying means lowers the height of the pocket, wherein the magnetic sealing means on the curtain engage the magnetic sealing means on the opposing sides of the portal, thereby sealing the portal. The portal is opened as the varying means raises the height of the pocket, wherein the magnetic sealing means on the curtain disengage the magnetic sealing means on the opposing sides of the portal, thereby unsealing the portal.

18 Claims, 2 Drawing Sheets

PORTAL COVERING FOR CONTROLLED ENVIRONMENTS

CROSS REFERENCE TO RELATED APPLICATION

This non-provisional application claims priority to U.S. Provisional Application No. 60/797,982, filed on May 5, 2006, the disclosure of which is incorporated herein by reference.

FIELD OF THE INVENTION

The present invention relates to the field of closures for windows, doors, or other portals and, more particularly, to portal coverings utilizing magnetic fastening strips for magnetically sealing a non-sliding roll-up closure for a portal in a controlled environment.

BACKGROUND OF THE INVENTION

Roll-up closures utilizing a flexible cover or curtain to cover a portal or opening such as a door or window are known. For example, in U.S. Pat. No. 5,566,736, Crider et al. teach a sealable curtain wherein each lateral margin of the cover has a strip of hook and loop fastener material affixed thereto, and a complementary strip is affixed to the lateral margins of the structure defining the portal. A first end of the cover is rigidly affixed across a first margin of the portal. The opposite end of the cover can be upturned and connected to a driven take-up roller mounted next to the first margin of the portal. In this embodiment, an elongated transverse rod is supported within the upturned end of the cover. In a second embodiment, a secondary transverse rod can be utilized to maintain tension on the cover (see FIGS. 1-2 of the U.S. Pat. No. 5,566,736). In a third embodiment, a second curtain can be employed (see FIG. 5 of the U.S. Pat. No. 5,566,736). In any of the embodiments, activation of the driven roller lengthens or shortens the effective length of the cover(s) while positioning the mating hook and loop fasteners to seal and unseal the cover(s) to the lateral margins of the portal.

Although the foregoing portal coverings are very effective in preventing the passage of wind, rain, light, insects, or any other elements through the portal, the use of hook and loop fasteners may not provide air tight seals for controlled environments (e.g. heated rooms, refrigerated rooms, "clean" rooms, or "quiet" rooms) or meet particular industry standards, such as those of the National Sanitation Foundation. For example, hook and loop fasteners tend to retain moisture, which can promote microbial growth, and are noisy while unsealing. Because of these features, hook and loop fasteners may be unacceptable in the case of industrial refrigerators and freezers used for food storage or facilities where low noise is required.

What is needed is a portal covering that can quietly and tightly seal a portal in a controlled environment to prevent the movement of air, moisture, and heat through the portal.

SUMMARY OF THE INVENTION

The present invention is a portal covering apparatus for opening and closing a portal in a controlled environment. The apparatus has a pair of spaced apart opposing lateral margins defining opposing sides of the portal. A flexible curtain for closing the portal has elongated side portions, with a first end and a second end each having a dimension commensurate with the separation of the lateral margins of the portal. The first end of the curtain is fixedly attached to the portal along a first end of the portal. The second end of the curtain is folded back on itself to define a pocket opening towards the first end of the portal. An elongated rod is contained within the pocket. Varying means are operatively connected to the second end of the curtain for varying the height of the pocket. A continuous magnetic strip, preferably about 5 inches wide, is attached along the lengths of the lateral margins of the portal. A continuous magnetically attractive strip, preferably about 4 inches wide, is attached along the elongated side portions of the curtain. The magnetic strip and the magnetically attractive strip releasably and repeatedly attach the elongated side portions of the curtain to the lateral margins of the portal concomitantly with positioning the pocket at selected positions, thereby providing an air tight seal of the portal. The invention includes a dual curtain design.

DETAILED DESCRIPTION OF THE PREFERRED EMBODIMENTS

Figure 1:
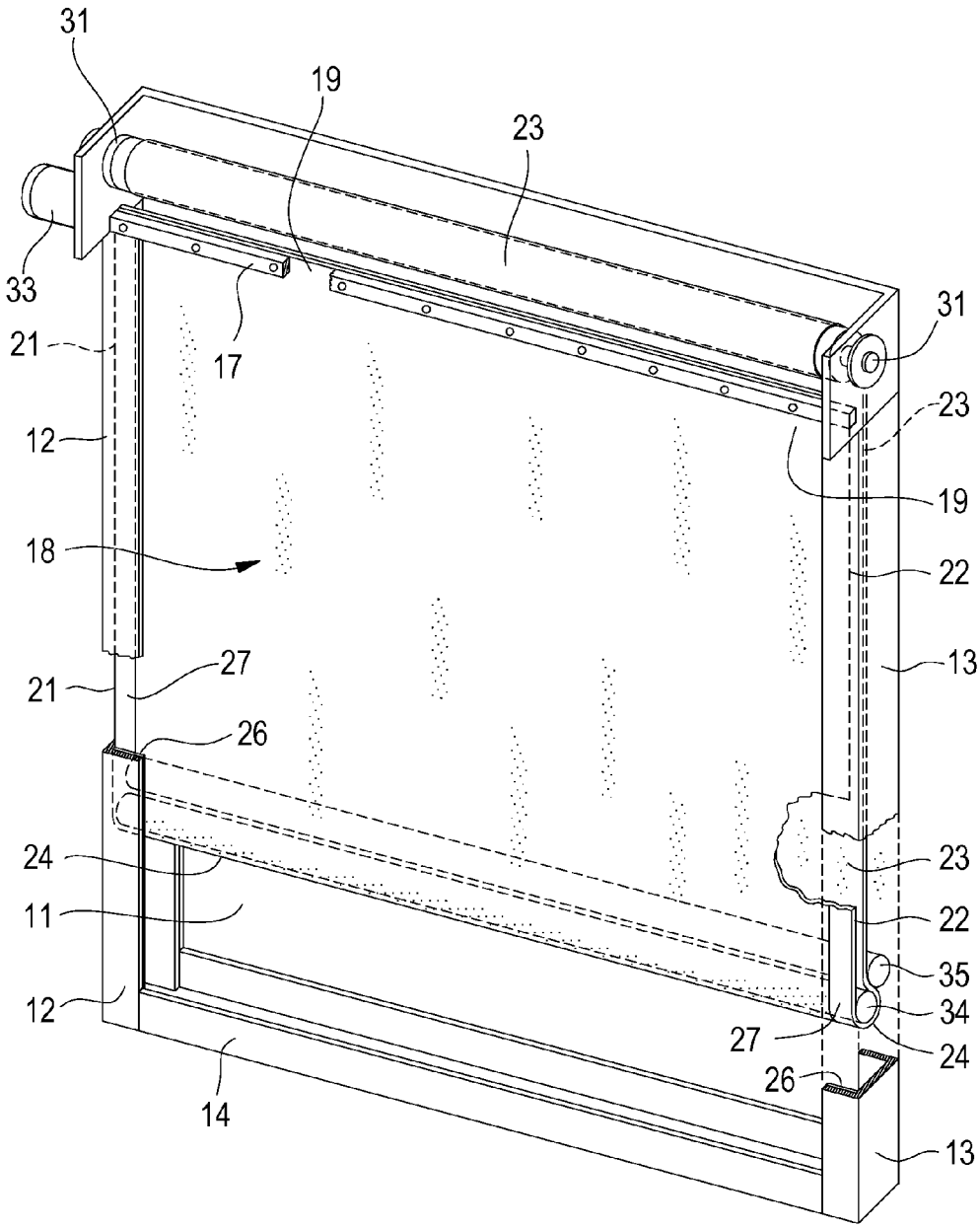
FIG. 1 is a perspective view of a first embodiment of the present invention in a partially raised position and shown partially in section.

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

The invention disclosed herein is technology related to U.S. Pat. Nos. 5,566,736, 5,752,557, 5,785,105, 5,960,847, 6,138,739, and 6,942,001, all of which are incorporated herein by reference. A more complete understanding of the invention may be obtained by reference to FIGS. 1 and 2, wherein an opening 11 is preferably provided with a pair of inwardly facing channel members 12 and 13, being C-shaped in the horizontal plane. Channel members 12 and 13 extend the full vertical length of the opening 11 and may terminate at a lower channel 14, which is upwardly opening and which extends across the width of the opening. In the case of a door-type opening, lower channel 14 would not be present. In some applications a sealing gasket 16, such as a compressible layer of foam, will be useful in the bottom of lower channel 14. Across the top of opening 11 is preferably a brace 17 which extends from channel 12 to channel 13. Thus, it may be seen that the opening is completely framed by members 12, 13, 14, and 17.

Attached to brace 17 is a first end 19 of a curtain 18, which is a flexible material selected in accordance with the purposes of the present invention for its ability to block light, air, or moisture from one side to the other side thereof. Therefore, curtain 18 is properly defined as a flexible barrier material, having a first end 19 secured to brace 17 and opposing longitudinal sides 21 and 22 which are longer than the length of channel members 12 and 13 such that the curtain 18 has an upturned lower end 23. Attached to channels 12 and 13 and to sides 21 and 22 are magnetically interacting closure members 26 and 27 capable of being selectively attached to and detached from each other.

The upturned end 23 may be directly connected to a transverse take-up spindle 31 mounted for rotation above the tops of channels 12 and 13. Alternatively, end 23 may be connected to the spindle 31 by cables or straps, and the spindle may include a spool for such cables or straps. In any case, the spindle 31 is driven by a reversible motor 33 attached to a selected means of control and spindle 31 supports the upturned end 23. An elongated roller 34, which may be a solid or tubular pipe, is supported within the pocket 24 of the curtain 18 created by the upturned end 23 and has opposing ends which preferably extend into the opposing channels 12 and 13 such that roller 34 can roll freely vertically in the channels, but cannot significantly pivot in the horizontal plane about its midpoint. Thus, as spindle 31 is rotated to wrap lower end 23 thereon, roller 34 is lifted within channel 12 and 13 such that it rolls up the channels 12 and 13.

As shown in FIG. 1, a weighting roller 35 is preferably captured at opposing ends within the channels 12 and 13 parallel to elongated roller 34. Weighting roller 35 is separated from roller 34 by the upturned end 23 of curtain 18. Thus, as spindle 31 rotates rollers 34 and 35 are constrained to rotate in opposite direction with the upturned end 23 of flexible curtain 18 passing between the rollers. As spindle 31 unwraps the curtain 18 or straps from itself, gravity urges the rollers 34, 35 and curtain to a lowered position.

When the curtain 18 is lowered, the roller 34 provides a very important function. Because the roller 34 is always in the bottom of the pocket 24, the roller 34 provides uniform weight across the width of the curtain 18 so that the curtain 18 is always taut and unwrinkled. As a result, the magnetically interacting strip 27 on the curtain 18 will properly align with the magnetic material 26 on the lateral margins 12, 13, thus maximizing the integrity of the seal between the magnetically interacting strip 27 and the magnetic material 26.

Figure 2:
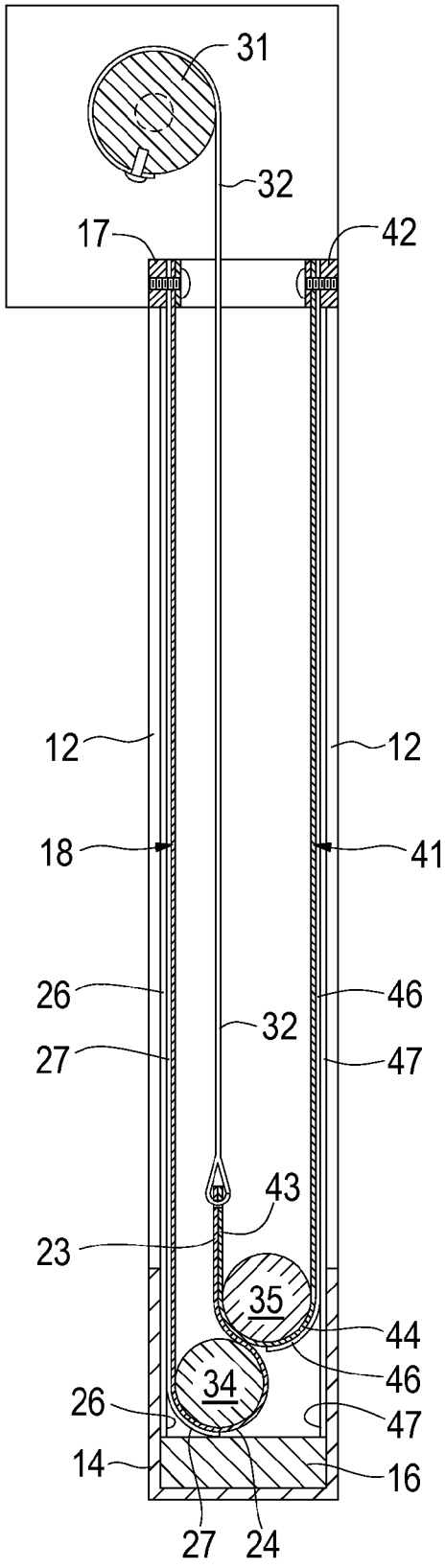
FIG. 2 is a side sectional view of a second embodiment of the present invention.

In an alternative embodiment shown in FIG. 2, a second curtain 41 is provided and is attached to a second brace 42. Second curtain 41 has the same structure as curtain 18 and has an upturned end 43 which passes beneath roller 35, but not roller 34. Thus, roller 35 is supported within the pocket 44 formed by upturned end 43 and serves the same function as roller 34, described above. Upturned ends 43 and 23 are attached such that they are commonly supported by spindle 31 via straps or common curtain 32, and move concomitantly vertically between braces 14 and 42. The dual curtain design has the added benefit of providing an insulating effect. It will be appreciated that the magnetically interacting closure members 46 carried by curtain 41 mate with magnetically interacting closure members 47 mounted on the channels 12 and 13 to provide a double sealed barrier. In some applications a sealing gasket 16, such as a compressible layer of foam-like material, will be useful in the bottom of lower channel 14.

Each of the opposing longitudinal sides of the curtain(s) 18, 41 has a continuous strip of magnetically responsive material 27, 46 affixed thereto, and a complementary continuous strip of magnetic material 26, 47 is affixed to the lateral margins 12 and 13 of the structure defining the portal 11. In order to achieve an air tight seal between the lateral margins 12 and 13 of the portal and the sides of the curtain(s) 18, 41, it is necessary to have surfaces that are smooth and uniform to form the seal. In a preferred embodiment, an extruded 60 mil flexible magnet (available from Flexmag Industries, Inc., Marietta, Ohio) is attached to the margins 12 and 13 of the portal. The magnetic strip is about 3 to 6 inches wide, preferably about 5 inches wide, and about 0.05 inches to 0.10 inches thick, preferably about 0.06 inches thick. The magnetic strip can be as long as needed. The strip preferably comprises a multi-pole magnet on the exposed side and an adhesive on the non-exposed side for attachment to the lateral margins 12 and 13.

A flexible magnetically interacting strip on the sides of the curtain(s) 18, 41 is preferably a thin spring steel having a thickness of about 0.005 inches and a width of about 3 to 5 inches, preferably about 3.5 to 4 inches. The spring steel is preferably covered with an adhesive woven tape that overlaps the spring steel by about 0.5 inch on each side. The overlapped edges of the tape adhere to the edges of the curtain(s) 18, 41 and are preferably sewn thereto. Alternately, the flexible magnetically interacting strip on the sides of the curtain (s) 18, 41 can be a non-magnetic rubber based or plastic product impregnated with a magnetically attractant material, such as ferrous oxide. The magnetically interacting strip preferably has a thin protective coating, such as a polyester film (e.g. Mylar), to protect the material from cracking and degradation. For example, a 25-30 mil "rubber steel" material sold under the name FERROSHEET™ (available from Flexmag Industries, Inc., Marietta, Ohio) may be attached to the sides of the curtain(s) 18, 41. The rubber steel strip is about 3 to 6 inches wide, preferably about 4 inches wide, and about 0.02 inches to 0.04 inches thick, preferably about 0.03 inches thick, and can be as long as needed.

The foregoing description has been limited to specific embodiments of this invention. It will be apparent, however, that variations and modifications may be made by those skilled in the art to the disclosed embodiments of the invention, with the attainment of some of all of its advantages and without departing from the spirit and scope of the present invention. For example, various magnetically interacting materials may be attached on the sides of the curtain. Further, any type of magnetic material can be used on the portal margins, including ceramic magnets, and can be used with the floating seal described in U.S. Pat. No. 6,138,739. Magnetic material may be used on the curtain edges and magnetically attractant material on the portal margins.

It will be understood that various changes in the details, materials, and arrangements of the parts which have been described and illustrated above in order to explain the nature of this invention may be made by those skilled in the art without departing from the principle and scope of the invention as described herein and as recited in the attached claims.

The invention claimed is:

1. An apparatus for opening and closing a portal in a structure, comprising:

a) a pair of spaced apart opposing lateral margins defining opposing sides of the portal;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) an elongated rod captured within said pocket;

d) varying means operatively connected to said second end of said curtain for varying the height of said pocket; and e) means for magnetically sealing said lateral margins of said portal to said elongated side portions of said curtain;

f) wherein said lateral margins of said portal comprise a magnetic material with a smooth and uniform surface and said elongated side portions of said curtain comprise a magnetically interacting material with a smooth and uniform surface, wherein said smooth and uniform surfaces of said magnetic material and said magnetically interacting material are operable to form an air tight seal; and g) wherein said magnetically interacting material is a flexible, thin spring steel strip covered with an adhesive tape that overlaps said spring steel strip and is adhesively secured to said elongated side portions of said curtain.

2. An apparatus according to claim 1, wherein said magnetic material has a width of 3 to 6 inches and a thickness of 0.05 to 0.10 inches.

3. An apparatus according to claim 1, wherein said magnetic material is a multi-pole flexible magnet.

4. An apparatus according to claim 1, wherein said adhesive tape is an adhesive woven tape that is further sewn to said elongated side portions of said curtain.

5. An apparatus according to claim 1, wherein said spring steel strip has a thickness of 0.005 inches and a width of 3 to 5 inches.

6. An apparatus for opening and closing a portal in a structure, comprising:

a) a pair of spaced apart opposing lateral margins defining opposing sides of the portal;

b) a first flexible curtain having elongated side portions, a first end and a second end each having a dimension commensurate with the separation of said lateral margins, with said first end of said first curtain being fixedly attached adjacent the portal along a first end thereof, said second end of said first curtain folded back on itself to define a pocket opening towards the first end of the portal;

c) an elongated rod captured within said pocket of said first curtain;

d) a second flexible curtain having elongated side portions, a first end and a second end each having a dimension commensurate with the separation of said lateral margins, with said first end of said second curtain being fixedly attached adjacent the portal along a first end thereof, said second end of said second curtain folded back on itself to define a pocket opening towards the first end of the portal;

e) an elongated roller captured within said pocket of said second curtain;

f) varying means operatively connected to said second ends of said first and second curtains for varying the height of said pockets; and g) means for magnetically sealing said lateral margins of said portal to said elongated side portions of said first and second curtains;

h) wherein said lateral margins of said portal comprise a magnetic material with a smooth and uniform surface and said elongated side portions of said first and second curtains comprise a magnetically interacting material with a smooth and uniform surface, wherein said smooth and uniform surfaces of said magnetic material and said magnetically interacting material are operable to form an air tight seal; and i) wherein said magnetically interacting material is a flexible, thin spring steel strip covered with an adhesive tape that overlaps said spring steel strip and is adhesively secured to said elongated side portions of said curtain.

7. An apparatus according to claim 6, wherein said magnetic material has a width of 3 to 6 inches and a thickness of 0.05 to 0.10 inches.

8. An apparatus according to claim 6, wherein said magnetic material is a multi-pole flexible magnet.

9. An apparatus according to claim 6, wherein said adhesive tape is an adhesive woven tape that is further sewn to said elongated side portions of said curtain.

10. An apparatus according to claim 6, wherein said spring steel strip has a thickness of 0.005 inches and a width of 3 to 5 inches.

11. An apparatus for opening and closing a portal in a structure, comprising:

a) a pair of spaced apart opposing lateral margins defining opposing sides of the portal;

b) a flexible curtain having elongated side portions, a first end and a second end each having a dimension commensurate with the separation of said lateral margins, with said first end of said curtain being fixedly attached adjacent the portal along a first end thereof, said second end of said curtain folded back on itself to define a pocket opening towards the first end of the portal;

c) an elongated rod captured within said pocket;

d) varying means operatively connected to said second end of said curtain for varying the height of said pocket; and e) means for magnetically sealing said lateral margins of said portal to said elongated side portions of said curtain;

f) wherein said lateral margins of said portal comprise a magnetic material with a smooth and uniform surface and said elongated side portions of said curtain comprise a magnetically interacting material with a smooth and uniform surface, wherein said smooth and uniform surfaces of said magnetic material and said magnetically interacting material are operable to form an air tight seal; and g) wherein said magnetically interacting material is a flexible, thin spring steel strip covered with an adhesive woven tape that overlaps said spring steel strip and is adhesively secured to said elongated side portions of said curtain and is further sewn to said elongated side portions of said curtain.

12. An apparatus according to claim 11, wherein said magnetic material has a width of 3 to 6 inches and a thickness of 0.05 to 0.10 inches.

13. An apparatus according to claim 11, wherein said magnetic material is a multi-pole flexible magnet.

14. An apparatus according to claim 11, wherein said spring steel strip has a thickness of 0.005 inches and a width of 3 to 5 inches.

15. An apparatus for opening and closing a portal in a structure, comprising:

a) a pair of spaced apart opposing lateral margins defining opposing sides of the portal;

b) a first flexible curtain having elongated side portions, a first end and a second end each having a dimension commensurate with the separation of said lateral margins, with said first end of said first curtain being fixedly attached adjacent the portal along a first end thereof, said second end of said first curtain folded back on itself to define a pocket opening towards the first end of the portal;

c) an elongated rod captured within said pocket of said first curtain;

d) a second flexible curtain having elongated side portions, a first end and a second end each having a dimension commensurate with the separation of said lateral margins, with said first end of said second curtain being fixedly attached adjacent the portal along a first end thereof, said second end of said second curtain folded back on itself to define a pocket opening towards the first end of the portal;

e) an elongated roller captured within said pocket of said second curtain;

f) varying means operatively connected to said second ends of said first and second curtains for varying the height of said pockets; and g) means for magnetically sealing said lateral margins of said portal to said elongated side portions of said first and second curtains;

h) wherein said lateral margins of said portal comprise a magnetic material with a smooth and uniform surface and said elongated side portions of said first and second curtains comprise a magnetically interacting material with a smooth and uniform surface, wherein said smooth and uniform surfaces of said magnetic material and said magnetically interacting material are operable to form an air tight seal; and i) wherein said magnetically interacting material is a flexible, thin spring steel strip covered with an adhesive woven tape that overlaps said spring steel strip and is adhesively secured to said elongated side portions of said curtain and is further sewn to said elongated side portions of said curtain.

16. An apparatus according to claim 15, wherein said magnetic material has a width of 3 to 6 inches and a thickness of 0.05 to 0.10 inches.

17. An apparatus according to claim 15, wherein said magnetic material is a multi-pole flexible magnet.

18. An apparatus according to claim 15, wherein said spring steel strip has a thickness of 0.005 inches and a width of 3 to 5 inches.

* * * * *